US011306653B2

(12) United States Patent
Killingsworth et al.

(10) Patent No.: US 11,306,653 B2
(45) Date of Patent: Apr. 19, 2022

(54) SYSTEM AND METHOD FOR ENGINE CONTROL WITH PRESSURE REACTIVE DEVICE TO CONTROL COMBUSTION TIMING

(71) Applicant: LAWRENCE LIVERMORE NATIONAL SECURITY, LLC, Livermore, CA (US)

(72) Inventors: Nicholas Killingsworth, Pleasanton, CA (US); Daniel L. Flowers, San Leandro, CA (US); Russell A. Whitesides, Castro Valley, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 0 days.

(21) Appl. No.: 17/040,065

(22) PCT Filed: Mar. 22, 2019

(86) PCT No.: PCT/US2019/023654
§ 371 (c)(1),
(2) Date: Sep. 22, 2020

(87) PCT Pub. No.: WO2019/183521
PCT Pub. Date: Sep. 26, 2019

(65) Prior Publication Data

US 2021/0025322 A1 Jan. 28, 2021

Related U.S. Application Data

(60) Provisional application No. 62/647,167, filed on Mar. 23, 2018.

(51) Int. Cl.
*F02B 75/04* (2006.01)
*F02D 15/00* (2006.01)
(Continued)

(52) U.S. Cl.
CPC ..... *F02B 75/044* (2013.01); *F02D 15/02* (2013.01); *F02F 3/10* (2013.01); *F02F 3/28* (2013.01); *F02P 5/15* (2013.01)

(58) Field of Classification Search
CPC ..... F02B 75/044; F02B 75/04; F02D 15/04; F02D 15/00; F02F 3/00; F02F 3/12
See application file for complete search history.

(56) References Cited

U.S. PATENT DOCUMENTS 1,125,375 A 1/1915 Newton et al.
1,429,164 A 9/1922 Ramsey
(Continued)

FOREIGN PATENT DOCUMENTS

WO WO-0009871 A1 2/2000

OTHER PUBLICATIONS

International Search Report and Written Opinion of the ISA issed in PCT/US2019/023654, dated Jul. 2, 2019; ISA/KR.

*Primary Examiner* — Long T Tran
(74) *Attorney, Agent, or Firm* — Harness, Dickey & Pierce, P.L.C.

(57) ABSTRACT

The present disclosure relates to a system for controlling ignition of an intake charge directed into an internal combustion engine. The system may have a movable component operably associated with at least one of a piston of the engine or a combustion chamber of the engine. The movable component may be tuned to deflect in response to a predetermined pressure being reached in a cylinder in which the piston is housed. The movable component operates to deflect in response to the predetermined pressure being reached in the cylinder as the piston travels toward top dead center during its compression stroke, to change a compression ratio of the engine.

13 Claims, 5 Drawing Sheets

(51) Int. Cl.

| | |
|---|---|
| ***F02D 15/02*** | (2006.01) |
| ***F02F 3/10*** | (2006.01) |
| ***F02F 3/28*** | (2006.01) |
| ***F02P 5/15*** | (2006.01) |

(56) References Cited

U.S. PATENT DOCUMENTS 3,205,878 A * 9/1965 Sune ..... F02B 75/044 123/48 AA
4,016,841 A * 4/1977 Karaba ..... F02B 75/044 123/78 B
4,104,995 A * 8/1978 Steinbock ..... F02D 15/00 123/78 D
4,144,851 A 3/1979 Prosen
4,148,284 A 4/1979 Prosen
4,372,256 A * 2/1983 Firey ..... F02B 71/00 123/23
4,873,947 A 10/1989 Ryan, III et al.
5,769,042 A * 6/1998 Popadiuc ..... F02B 41/00 123/78 B
5,934,228 A 8/1999 Wheat
7,318,397 B2 1/2008 Ward
9,239,003 B1 1/2016 Manke
2003/0136358 A1* 7/2003 Galvin ..... F02F 3/00 123/48 B
2006/0005793 A1 1/2006 Ward
2010/0154749 A1* 6/2010 Barberato ..... F02B 75/32 123/48 C
2011/0192370 A1 8/2011 Wang
2012/0305354 A1 12/2012 Preukschat et al.
2014/0165963 A1* 6/2014 Langham ..... F01L 9/10 123/350
2015/0167562 A1 6/2015 Kim
2015/0252197 A1* 9/2015 Ershad Langroudi ..... C14C 11/003 427/553
2016/0312693 A1 10/2016 Brevick
2018/0252197 A1* 9/2018 Glugla ..... F02P 5/152
2020/0408145 A1* 12/2020 Johansson ..... F02B 75/044
2021/0025322 A1 1/2021 Killingsworth et al.

* cited by examiner

SYSTEM AND METHOD FOR ENGINE CONTROL WITH PRESSURE REACTIVE DEVICE TO CONTROL COMBUSTION TIMING

CROSS-REFERENCE TO RELATED APPLICATIONS

This application is a U.S. National Phase Application under 35 U.S.C. 371 of International Application No. PCT/US2019/023654, filed on Mar. 22, 2019, which claims the benefit of U.S. Provisional Application No. 62/647,167, filed on Mar. 23, 2018. The entire disclosure disclosures of the above application is applications are incorporated herein by reference.

STATEMENT OF GOVERNMENT RIGHTS

The United States Government has rights in this invention pursuant to Contract No. DE-AC52-07NA27344 between the U.S. Department of Energy and Lawrence Livermore National Security, LLC, for the operation of Lawrence Livermore National Laboratory.

FIELD

The present disclosure relates to engine control/management systems for reciprocating piston driven engines, and more particularly to an engine control system which controls a compression ratio acting on a mixture of air, which may or may not also include exhaust gas residuals and fuel within a combustion chamber of a reciprocating piston engine by controlling a movable surface associated with at least one of the piston, a cylinder wall or a combustion chamber, to provide even greater control over engine efficiency and emissions.

BACKGROUND

This section provides background information related to the present disclosure which is not necessarily prior art.

Reciprocating internal combustion engines are used throughout the world to convert chemical energy to mechanical energy in a wide assortment of applications. Such applications include, without limitation, cars, trucks, boats, pumps, ATVs, snow machines, earth moving equipment, etc. Spark-ignited and diesel engines have prevailed during the last century; however, as emission standards have become more stringent, engines that employ low temperature combustion (LTC) strategies have dominated the focus of research labs and are trickling into production.

LTC relies on heavy dilution of the in-cylinder fuel/air mixture with excess air or recirculated exhaust gas. This dilution can lower the temperature of the air/fuel mixture within the cylinder during combustion. Ignition is typically initiated via the compression stroke of a piston. Typically, as the piston nears top dead center of its stroke, the air fuel mixture is compressed and its temperature rises. The compressed air/fuel mixture may be ignited using a spark plug or possibly even through just the heat built up during the compression stroke, such as with a diesel powered engine. This combustion process is very sensitive to the engine operating point, as well as to environmental conditions affecting the temperature of the ambient air being drawn in through the vehicle's intake manifold.

The efficiency of LTC engines is largely determined by the engine's compression ratio (the ratio of the largest in-cylinder volume to the smallest in-cylinder volume, over an engine cycle). Engine compression ratios are typically fixed and set as a compromise to be able to operate over a wide range of conditions. Engine efficiency could be improved if the compression ratio could be varied based on the momentary conditions.

A particularly difficult condition for LTC engines is starting when the engine walls are cold (i.e., after the engine has not been running for some time). Ideally under such conditions an engine would operate with a high compression ratio to ensure rapid ignition. However, the compression ratio of standard engines are limited to avoid abnormal combustion (i.e., excessively high combustion temperatures), excessive noise, and structural damage to the engine components that may occur under high engine loads.

Advances in automotive computational power and new actuator technologies allow adjustment of the "effective" compression ratio of the engine using variable valve technologies. The intake valve closing can be phased early (before the piston has reached bottom dead center ("BDC")) or late (after the piston has passed bottom dead center) reducing the amount of trapped intake charge. Both valve timing strategies reduce the pressure at the start of the compression stroke of the piston. At the end of the compression stroke, the pressure and temperature are reduced, compared to what would be seen with conventional valve timing, because the charge is not compressed through the entire geometric compression (i.e., the full stroke of the piston from BDC to top dead center ("TDC")). These strategies reduce the amount of trapped intake charge-comprised of air and/or fuel, thus reducing the amount of power generated by the engine.

An alternative means of changing the effective compression ratio is the use of a surface within the engine cylinder that deflects as the pressure increases; effectively increasing the minimum volume and reducing the compression ratio. In practice this could be achieved using a plunger in the engine cylinder head or a two-piece piston with a compliant member connecting the top surface and the trunk (i.e., piston skirt) attached to the connecting rod. This idea has been the source of numerous patents beginning as early in the $20^{th}$ century. However, the apparatuses described in these patents were all directed towards conventional spark ignited (SI) and diesel engines with the motivation of reducing the peak in-cylinder pressure to minimize the occurrence of knock, and increasing the compression ratio at part load in spark ignition (SI) engines.

In a standard throttled SI engine, the pressure during the compression stroke can be adjusted with the throttle, but the temperature of the in-cylinder gas is essentially fixed based on the compression ratio. Accordingly, what is needed is some system which allows for controlling a low temperature combustion process to optimize fuel efficiency and/or the power produced by the engine.

SUMMARY

This section provides a general summary of the disclosure, and is not a comprehensive disclosure of its full scope or all of its features.

In one aspect the present disclosure relates to a system for controlling ignition of an air/fuel mixture intake charge directed into an internal combustion engine. The system may comprise a movable component operably associated with at least one of a piston of the engine or a combustion chamber of the engine. The movable component may be tuned to deflect in response to a predetermined pressure being reached in the combustion chamber during movement of the piston within a cylinder of the engine, as the piston travels toward top dead center during its compression stroke, to change a compression ratio of the engine.

In another aspect the present disclosure relates to a system for controlling ignition of an intake charge directed into an internal combustion engine, where the engine has a piston moving axially within a cylinder, a portion of the cylinder and a portion of a cylinder head forming a combustion chamber, and the piston moves towards and away from the cylinder head. The system may comprise a movable component operably associated with at least one of the piston or the combustion chamber of the engine. A biasing is disposed in contact with the movable component to exert a biasing force on the movable component. The biasing force helps to control deflecting axial movement of the movable component in response to a predetermined pressure being reached in the combustion chamber during a compression stroke of the piston, to change a compression ratio of the engine.

In still another aspect the present disclosure relates to a method for controlling ignition of an air/fuel mixture of an internal combustion engine. The method may comprise configuring at least one of a piston or a portion of a combustion chamber of an engine with a movable component which is movable in response to a predetermined pressure being reached in a cylinder in which the piston is housed and moving axially in a reciprocating manner. The method further includes causing the movable component to deflect in response to the predetermined pressure being reached in the cylinder as the piston travels toward top dead center during a compression stroke. This influences compression developed within the combustion chamber, and thus a temperature of the air fuel mixture, to control ignition of the air/fuel mixture.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure. Corresponding reference numerals indicate corresponding parts throughout the several views of the drawings, in which.

Figure 6:
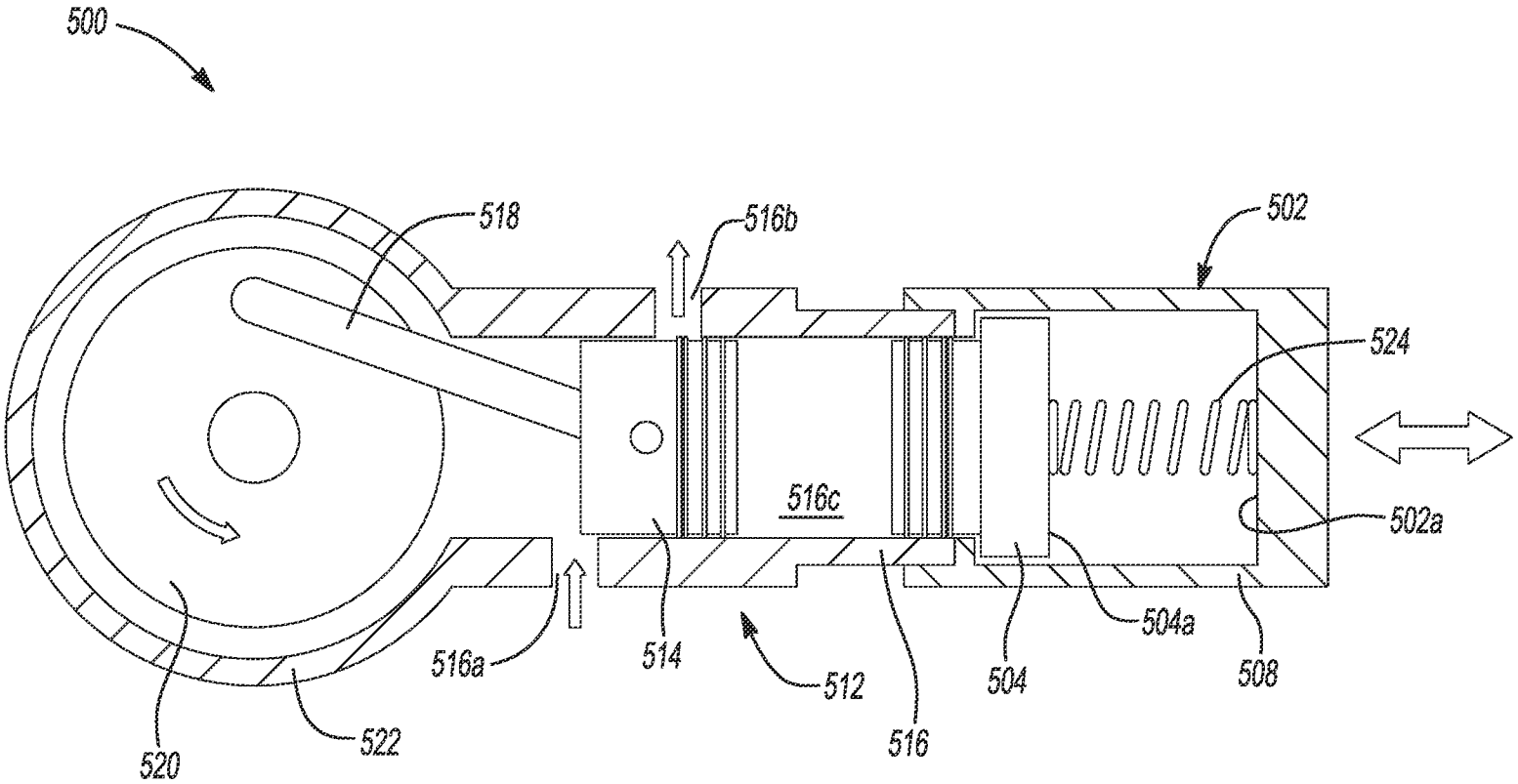
Figure 7:
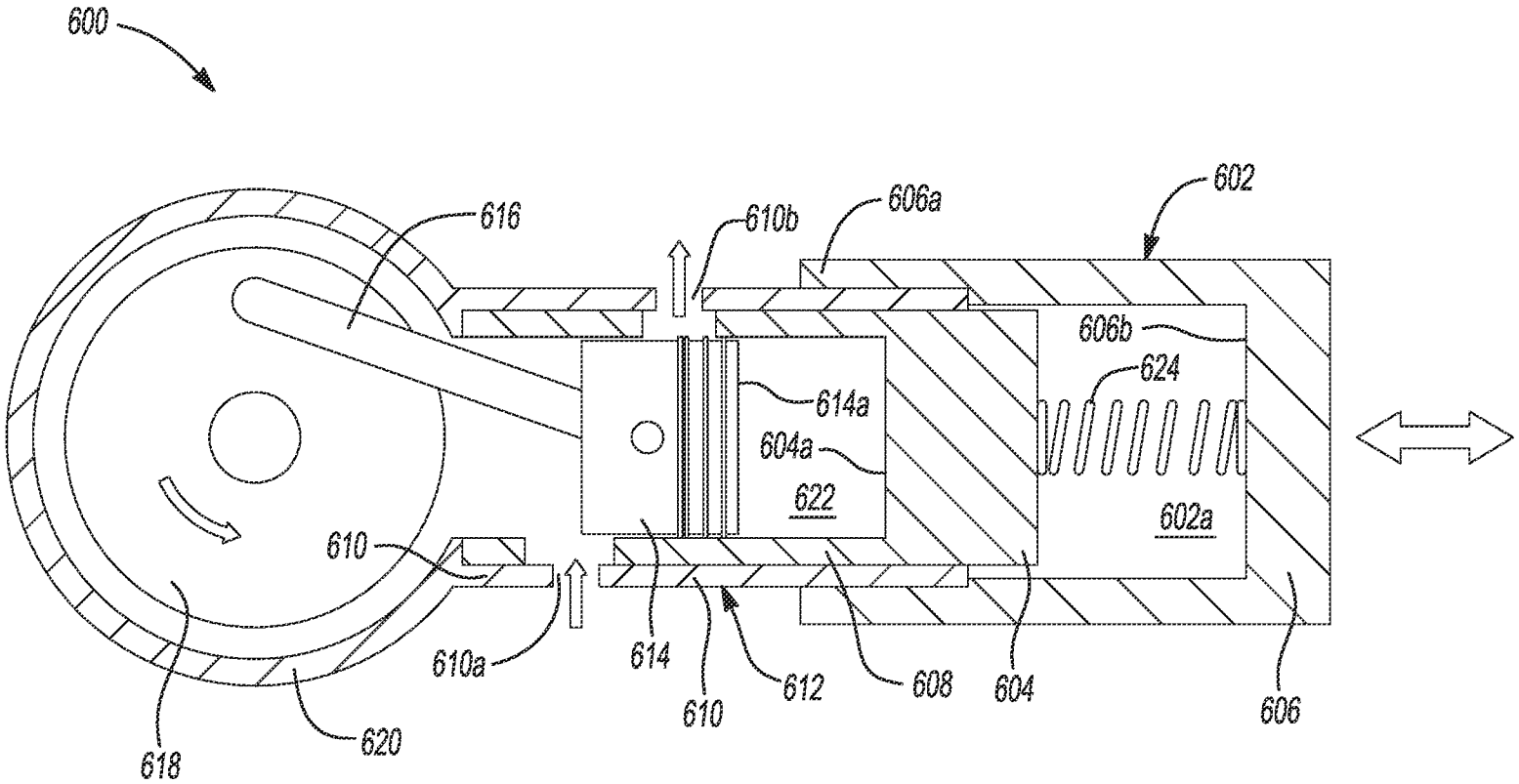

FIG. 6 is a simplified side cross sectional view of another embodiment of the present disclosure which incorporates a secondary piston forming a portion of a cylinder head assembly, which is able to move linearly a small amount to controllably modify a compression ratio; and FIG. 7 is a simplified side cross sectional view of another embodiment of the present disclosure which incorporates a cylinder head assembly having a slidable internal liner that extends into the cylinder, and which is able to move linearly a small amount to modify a compression ratio.

DETAILED DESCRIPTION

Example embodiments will now be described more fully with reference to the accompanying drawings.

The present disclosure is related to various embodiments of a movable or "deflecting" surface of a component of a spark ignited (SI) internal combustion engine which is used to alter a temperature of an in-cylinder air/fuel mixture within a combustion chamber of the engine during the combustion stroke of a piston. Thus, even though the peak pressure within the cylinder is essentially fixed, the temperature of the in-cylinder gas can be adjusted simply based on controlling pressure at the beginning of the compression stroke.

Figure 1:
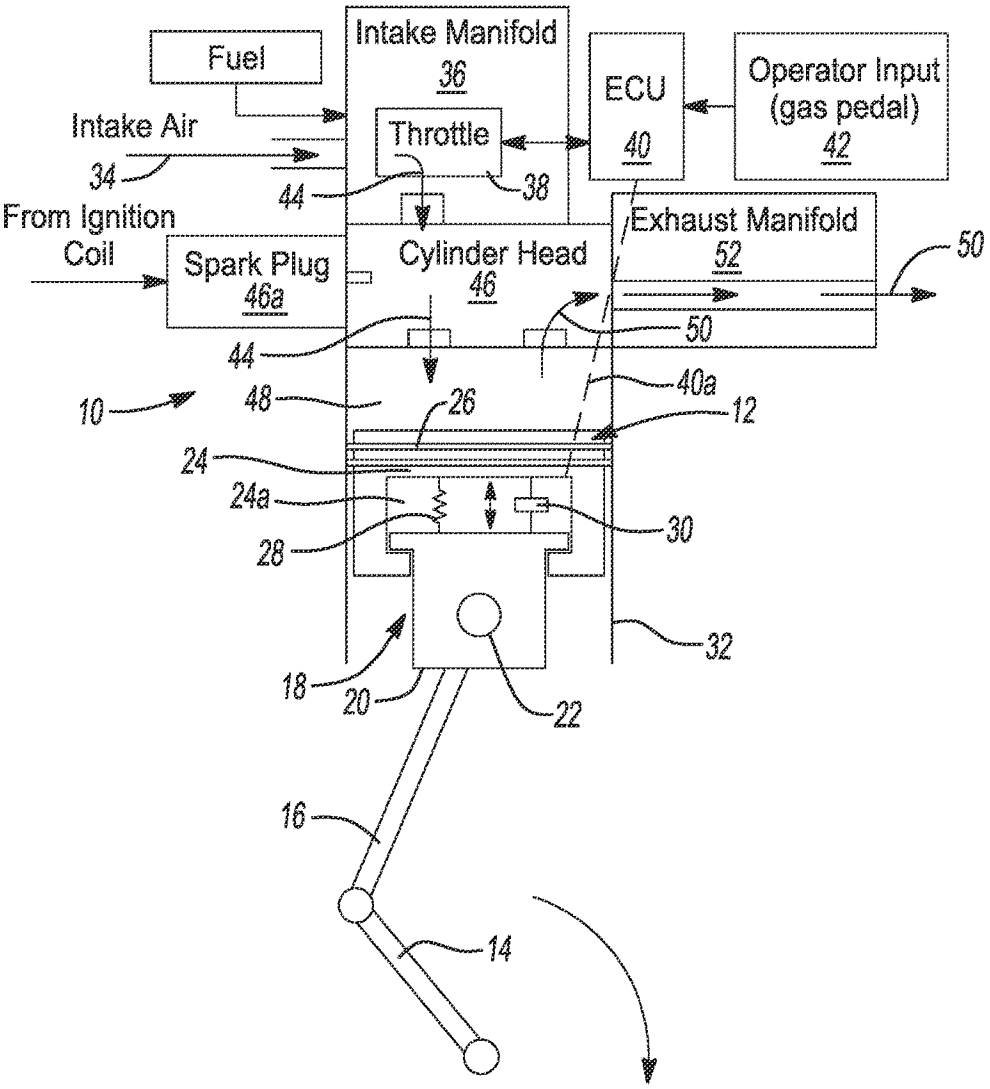
FIG. 1 is a high level block diagram of a cylinder of an internal combustion engine incorporating a movable, pressure responsive surface integrated into the construction of a piston, which may be used to control a compression ratio of an engine, and indirectly control the combustion timing of a combustible gas.

Referring to FIG. 1, a portion of an internal combustion, reciprocating piston engine 10 is shown. The engine 10 in this embodiment includes a piston 12 connected to a crankshaft 14 via a connecting rod 16. The connecting rod 16 is connected to a multi-piece skirt assembly 18 of the piston 12. A first portion 20 of the skirt assembly 18 connects to a distal end of the connecting rod via a wrist pin 22. A second portion 24 of the skirt assembly is coupled to the first portion 20 in what may be viewed as a sliding or telescoping manner. The second skirt portion 24 has a crown 26 which is used to compress the gas (air/fuel mixture) during the combustion stroke of the piston 12. At least one biasing component 28 is disposed within a cavity 24*a* formed by the second skirt portion 24, and between the first and second skirt portions 20 and 24, which tends to bias the second skirt portion 24 into a predetermined position when no pressure is acting on the piston 12. A principal feature of the piston 12 is therefore that the second skirt portion 12, and thus the crown 26, is able to move (i.e., deflect) freely relative to the first skirt portion 20 during the piston's compression stroke.

In FIG. 1 the biasing component 28 is shown as a coil spring, although alternatively other types of biasing structures could be used. For example, a Belleville washer could be used in place of, or possibly even in connection with the coil spring biasing component 28. A dashpot 30 can be added to provide damping and change the dynamics of the motion of second skirt portion 24 relative to the skirt assembly 18. Other options for providing a movable surface could be forming the crown 26 of the piston 12 as an engineered surface that is able to elastically deform in response to reaching a predetermined pressure. Such a surface may be made by forming the crown 26 using an additive manufacturing process. Other ways for implementing a deflectable surface may be, without limitation, the use of high temperature rubber for the crown 26 or possibly at least a section of the second skirt portion 24 of the piston 12. Still further, a pneumatic or hydraulic spring-like subsystem (shock absorber-like component), or even a torsional spring could potentially be integrated into the piston 12 to couple the motion between the second skirt portion 24 and the first skirt portion 20. As the second skirt portion 24 deflects, the spring angle will change and store energy. All of the above components enable energy storage to be achieved in response to increasing pressure on the piston 12.

Each of the foregoing implementations of a spring enable the crown 26 of the piston 12 to move independently relative to the first skirt portion 20 in response to the pressure experienced within a cylinder 32 of the engine 10, which in turn enables the pressure experienced by the air fuel mixture, and thus its temperature, to be controlled during the compression stroke. This enables the combustion timing of the engine 10 to be varied as needed to optimize efficiency and/or power produced by the engine. More particularly, the deflectable crown 26 enables the temperature of the air/fuel mixture to be controlled during the compression stroke of the piston 12, by controlling the compression ratio, which in turn allows the timing of combustion of the air/fuel mixture to be carefully controlled.

During operation of the engine 10, a quantity of ambient air 34 is ingested into an intake manifold 36 of the engine, possibly along with a quantity of fuel. The fuel could be direct injected as well. The intake manifold 36 may include a throttle 38 for controlling the quantity of fuel that is admitted into the intake manifold. The throttle 38 may be controlled by an engine control unit (ECU) 40 which receives a signal from an operator input 42 (i.e., gas pedal), or the throttle may receive the operator input signal directly from the input component 42. A combustible gas (i.e., air/fuel mixture) 44 is then formed by the mixture of a quantity of air and fuel which is charged into a cylinder head 46. The cylinder head 46 communicates with the cylinder 32 and helps to form a combustion chamber area 48, where the gas 44 is combusted via a spark produced by a spark plug 46*a* as the piston 12 approaches top dead center ("TDC") during its combustion stroke. It will be appreciated that TDC defines the upper limit of the piston 12 travel and bottom dead center ("BDC") defines the bottom limit of the piston travel. Exhaust gas 50 produced from the combustion process may be exhausted through an exhaust manifold 52 to the ambient environment or through other components (e.g., catalytic converter, muffler, etc.) before being released into the atmosphere.

As the piston 12 approaches TDC during the combustion stroke, the second skirt portion 26 may be deflected downwardly in the illustration of FIG. 1. The amount of downward deflection may depend on the pressure developed during the compression stroke, as well as other variables associated with the spring 28 and/or the dashpot 30, thus reducing the effective compression ratio of the engine 10 as the piston reaches TDC. The deflectable surface (i.e., the crown 26) of the piston 12 can thus be used to control combustion timing during the compression stroke.

If the spring 28 or dashpot 30 forms an actively controllable damper (e.g., hydraulic or pneumatic piston-like component), it may be directly controllable by, or may provide a feedback signal to, the ECU 40, as indicated by dashed line 40*a*.

Figure 2:
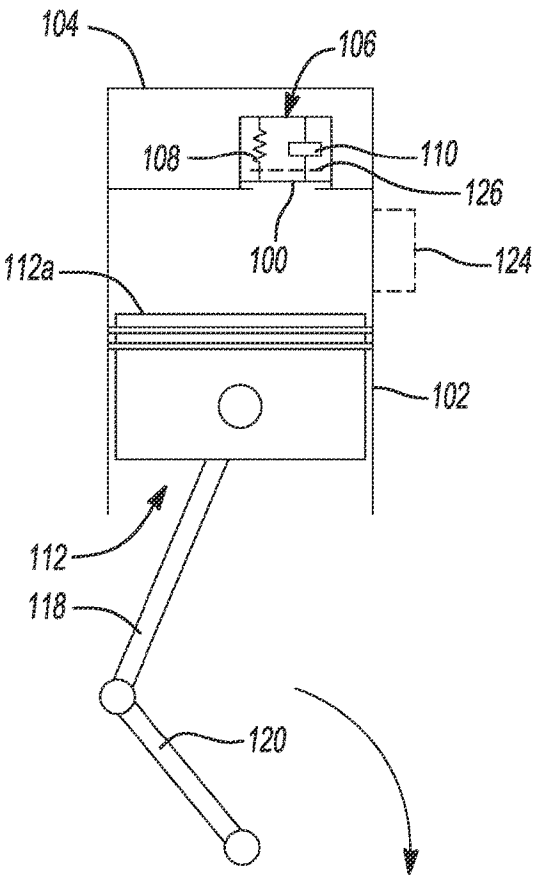
FIG. 2 shows an another embodiment of a movable, pressure responsive surface integrated into a combustion chamber, or alternatively into a wall of a cylinder forming a portion of the combustion chamber.

FIG. 2 illustrates another embodiment of the present disclosure in which the movable surface is achieved through the use of a movable element 100 disposed within a portion of a cylinder 102 or cylinder head 104 of an engine. It will be appreciated that the cylinder 102 and the cylinder head 104 may be used in connection with an engine such as described in connection with FIG. 1, but the various other components of the engine 10 described in connection with FIG. 1 have not been shown in the embodiment of FIG. 2.

The movable element 100 may be associated with a biasing subassembly 106 that includes the movable element 100 as well as one or more biasing elements 108 and/or 110 which provide a predetermined biasing force against which the movable element 100 works during the compression stroke of a piston 112. The biasing element 108 is shown as a coil spring in this example, while the biasing element 110 is shown as a pneumatic or hydraulic spring. All of the biasing options mentioned in connection with the components 28 and 30 are useable in the biasing subassembly 106 shown in FIG. 2. The biasing subassembly 106 of FIG. 2 may be used with an engine having a conventional piston 112 with a single piece construction where a crown 114 and a skirt portion 116 are formed as a single piece component. The piston 112 may be reciprocated via a conventional connecting rod 118 by a conventional crankshaft 120.

The biasing subassembly 106 may be integrated into the cylinder head 104. Optionally, the biasing subassembly may be integrated into a wall portion of the cylinder 102, as shown by dashed lines 124. Dashed line 126 shows how the movable element 100 may deflect away from a crown portion 112*a* of the piston during the compression stroke to reduce the compression ratio at TDC. The biasing subassembly 106 can therefore be used in the same manner explained above for the engine 10 to help control precisely when combustion occurs by controlling the pressure of the air/fuel mixture, and thus the temperature of the air/fuel mixture, during the compression stroke.

The movable surface (e.g., piston crown 26 or biasing elements 108/110) in the various embodiments discussed herein can be designed to deflect at a fixed pressure. When the intake pressure is high, such as when the throttle 38 is opened a large amount, or even wide open, the movable surface can be designed to deflect significantly during the compression stroke, resulting in a lower compression ratio. The intake air temperature is essentially fixed based on the ambient environment; therefore, the temperature of the air/fuel mixture 44 when the piston 12 is at TDC within the cylinder 32 decreases with a lower compression ratio. When the intake pressure is low, such as when the throttle 38 is open only a small amount, the movable surface 26 or 108/110 will deflect minimally as the piston 12 reaches TDC during its compression stroke, resulting in a higher compression ratio. The higher compression ratio yields a higher temperature at TDC for the air/fuel mixture 44 being combusted. Therefore, by controlling the throttle 38 in the intake manifold 36, the temperature of the air/fuel mixture 44 within the combustion chamber area 48 of the cylinder 32 can be quickly adjusted based on the effective compression ratio.

Alternatively, rather than using a throttle to control the intake pressure, the intake pressure may be adjusted using well known late and early intake valve closing strategies (e.g., variable valve timing), or a throttle positioned in an exhaust manifold could be used to retain residual exhaust gas. For turbocharged and supercharged engines, the compression ratio may be automatically adjusted based on the amount of boost being used, thus reducing the occurrence of knock and abnormal combustion.

This systems and methods disclosed herein for controlling the compression ratio and the in-cylinder temperature have significant implications for engines utilizing Low Temperature Combustion (LTC), as they can be readily implemented to control engine emissions and efficiency. The systems and methods of the present disclosure may also be used to enable multi-mode operation. For example, LTC modes may be implemented which require higher compression ratios, and which are used for low loads when the engine is throttled and/or with low boost pressures, while standard combustion modes may be used at higher loads where a lower compression ratio is desirable. The teachings of the present disclosure are also expected to aid significantly in starting the engine when the engine is cold.

The systems and methods of the present disclosure may also help to compensate for the effect of altitude on engines. It is well known that as an engine is operated at increasing altitude, atmospheric pressure decreases. The various embodiments of the present disclosure may be used to increase the compression ratio, and therefore the temperature of the air/fuel mixture, at TDC. This action compensates for the standard decrease in ambient temperature which typically accompanies an increase in altitude. The various embodiments of the present disclosure may thus increase the engine's efficiency by compensating for a decrease in trapped mass.

The various embodiments of the present disclosure may also improve part load efficiency since they operate to increase the compression ratio at lower loads when the intake charge is throttled. At higher loads, when abnormal combustion is more likely to occur, the pressure will be limited due to the movable crown 26 or movable component 108/110. Thus, the engine 10 can be built to withstand lower peak pressures, which can reduce the cost of the engine.

Still another benefit is that the movable crown 26 or movable component 108/110 may be used to help estimate the in-cylinder pressure through measurement of its displacement, or optionally through the use of a strain gauge. For example, the measured displacement of the piston crown 26 relative to the first skirt portion 20 may be used in a feedback control system to better control the efficiency of the engine (e.g., to further control the throttle 38 of the engine 10 or possibly even the valve timing, as indicated by dashed line 40*a* in FIG. 1).

And while the foregoing discussion has been centered around a spark ignited engine, it will be appreciated that the teachings of the present disclosure are not limited to use with only spark ignited engines, but may be applied to compression ignition engines, such as diesel engines, just as well.

The following is a partial list of ways additional ways in which a surface within the engine cylinder may be made to deflect under pressure and allow control of the in-cylinder temperature:

connecting rod that deflects axially under compression;

crankshaft that torsionally deflects;

movable smaller secondary piston within a main piston that deflects under pressure;

opposed cylinders each having a piston, where at least one of the pistons, or even both of the pistons in both cylinders, may deflect under a predetermined pressure;

a piston located within the cylinder head that can deflect under pressure;

a piston wrist pin, wrist pin bushing or wrist pin bearing that has compliance sufficient to produce a tangible, predetermined drop in the compression ratio in response to a predetermined pressure;

a fuel injector, a spark plug, or a glow plug that can physically move based on in-cylinder pressure to increase the cylinder volume, and thus decrease the compression ratio;

intake or exhaust valves that can physically move, based on in-cylinder pressure, to increase the cylinder volume, and thus reduce the compression ratio; and an engineered surface in the piston crown or in the combustion chamber of the cylinder head that elastically deforms in response to a predetermined pressure.

Figure 3:
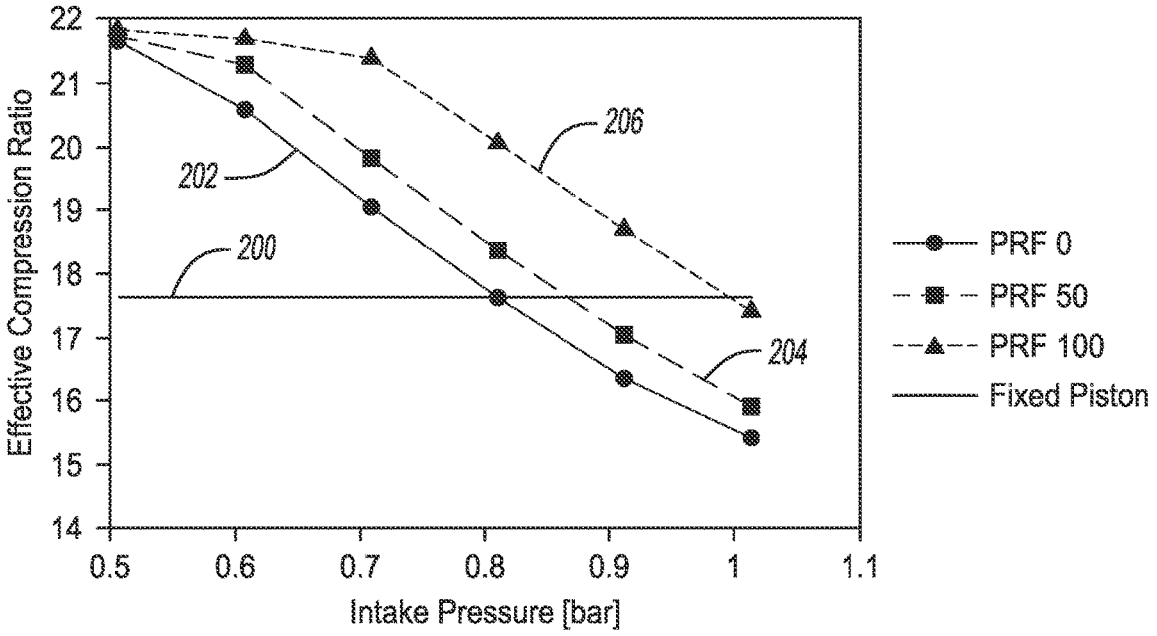
FIG. 3 is a graph illustrating the effective compression ratio versus intake pressure, and showing that for an engine with a deflecting surface, the effective compression ratio decreases as the intake pressure increases, resulting in lower in-cylinder temperatures as the piston reaches the top of its stroke.
Figure 4:
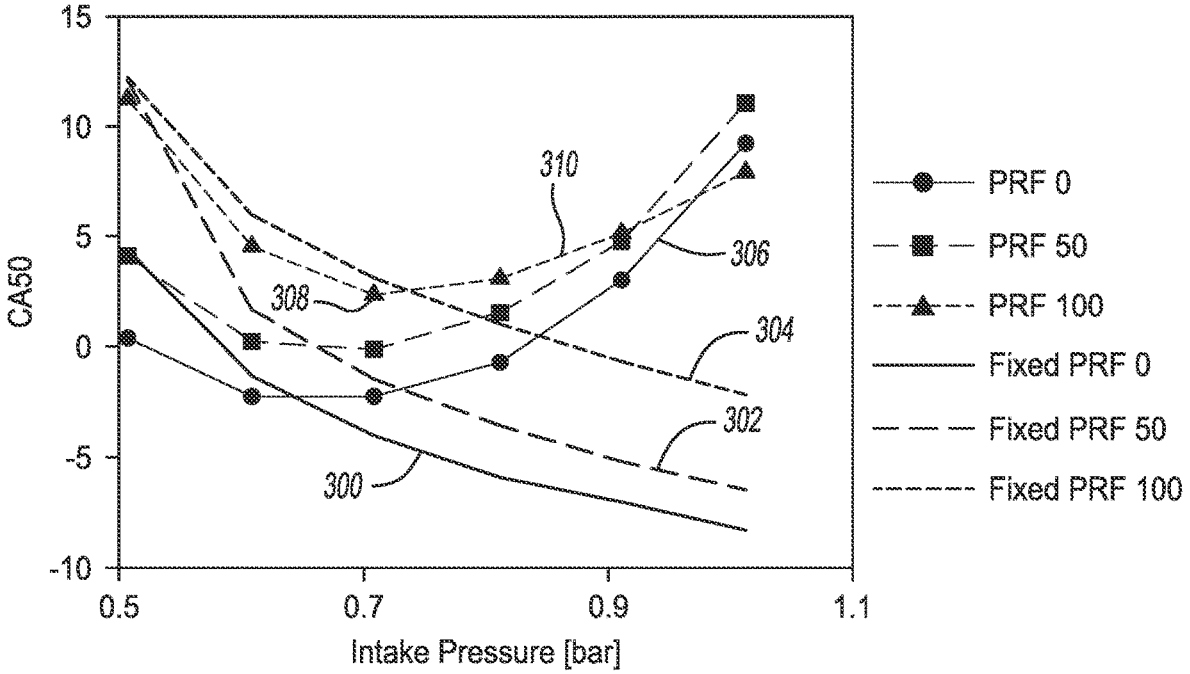
FIG. 4 is a graph showing an example of engine combustion timing versus intake pressure, and wherein the plots show that for a standard engine, as the intake pressure increases the combustion timing advances, and for an engine with a surface that deflects, the combustion timing advances at first but as the effective compression ratio decreases the combustion timing retards.
Figure 5:
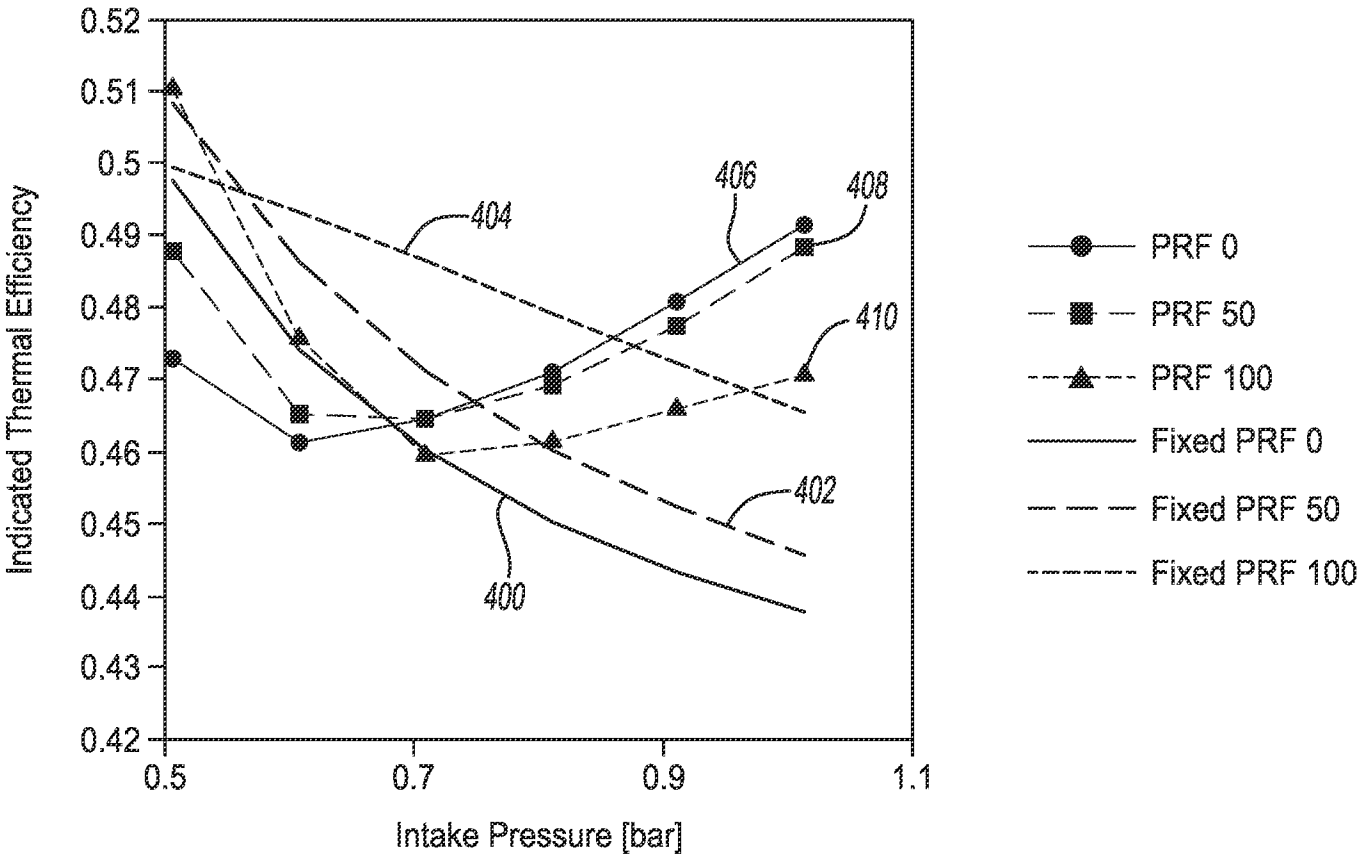
FIG. 5 is a graph showing indicated thermal efficiency versus intake pressure, and illustrating that for a standard internal combustion engine, as the intake pressure increases the combustion phasing is advanced before top dead center resulting in negative work and increased heat transfer.

FIGS. 3-5 pertain to the results of simulations of a standard engine and an embodiment of an engine with a deflecting surface which were run to demonstrate the latter's benefits. The deflecting surface was modeled as a spring mass damper system and thus the in-cylinder volume changes due to the dynamics of the deflecting surface which changes based on the in-cylinder pressure in addition to the slider crank piston motion. Both models use a zero-dimensional representation of the engine such that all gas within the engine cylinder is assumed to be at the same thermodynamic state. The model includes detailed chemical kinetics of the fuel and air. The fuel modeled is primary reference fuel (PRF): a mixture of n-heptane and iso-octane. N-heptane has an octane number of 0 and iso-octane an octane number of 100, where the octane number of a mixture is proportional to the volume of iso-octane. PRF 0 contains only n-heptane, PRF 50 contains 50% n-heptane and 50% iso-octane by volume and PRF 100 contains only iso-octane; therefore, a study of these three mixtures spans a broad range of ignition sensitivity.

FIG. 3 shows plots 200, 202, 204 and 206 of the effective compression ratio as the intake pressure is varied for three mixtures of PRF (plots 202-206), and a plot 200 of the compression ratio with a fixed piston (i.e., having no movable/deflectable surface). The effective compression ratio is the ratio between the maximum and minimum volume of the engine cylinder during the compression process and differs from the geometric compression ratio because of deflection of a movable/deflectable surface (such as surface 26 or components 108/110) and the intake valve close timing. The minimum volume increases as the intake pressure is increased, which decreases the effective compression ratio. These plots show that for an engine with a movable/deflectable surface, the effective compression ratio decreases as the intake pressure increases, resulting in lower in-cylinder temperatures as the piston reaches the top of its stroke and retarded combustion time (see FIG. 4). Combustion timing—as measured by the crank angle at which 50% of fuels heat has been released, CA50—slightly after TDC, tends to be optimal and result in peak efficiency. There is also a change in the effective compression ratio due to the fuel: a PRF 0 results in the lowest effective compression ratio for each intake pressure and as the PRF increases so does the effective compression ratio. PRF 0 is the most reactive fuel and ignites the earliest for both engine types as can be seen in FIG. 4. This early ignition results in heat release and a rise in pressure that causes the deflectable piston crown 26 or the movable element 100 to deflect and the in-cylinder volume to decrease relative to a standard engine having a piston with no movable/deflectable component. The least reactive fuel, PRF 100, ignites later and thus results in the highest effective compression ratio. This behavior is advantageous because less reactive fuels require higher temperatures to ignite, and thus this invention helps achieve the delayed combustion through self-regulation.

FIG. 4 shows a plurality of plots 300-310 to illustrate engine combustion timing (CA50) versus intake pressure.

The plots 300-310 shows that for a standard engine with no movable/deflectable component associated with the piston or combustion chamber (plots 300-304), as the intake pressure increases the combusting timing advances. For an engine with a surface that moves or deflects in response to pressure (plots 306-310), the combustion timing advances at first but as the effective compression ratio decreases the combustion timing retards. There is more variation in CA50 for the fixed piston engine versus the engine with a surface that moves or deflects.

The indicated thermal efficiency for these cases is shown in FIG. 5 by plots 400-410. It can be noted that the efficiency of the standard engine (i.e., no movable or deflectable element with piston or combustion chamber) goes down with intake pressure, as shown by plots 400-404. However, with the use of a movable/deflectable component, the engine efficiency initially goes down for the engine but then increases, as shown by plots 406-410. For a standard engine, as the intake pressure increases the combustion phasing is advanced (see FIG. 3) before TDC, resulting in negative work and increased heat transfer, which serve to decrease the thermal efficiency. For the engine with a surface that moves/deflects, the combustion phasing does not advance as much, resulting in more efficient operation. Another important point of note is that the efficiency is highest for a PRF 100 for the standard engine (i.e., having no movable/deflectable component), but the engine with a movable/deflectable surface has the opposite trend, and the PRF 0 has the highest efficiency once the intake pressure is beyond 0.7 bar. This indicates that for this simulated embodiment, the engine with a deflecting surface is more efficient with a lower octane fuel rather than higher octane fuel, thus reversing the trend seen in modern day gasoline fueled, spark ignited engines.

Referring to FIG. 6, a system 500 is shown in accordance with another embodiment of the present disclosure. The system 500 in this example makes use of a cylinder head assembly 502 which includes a secondary piston 504 housed within an interior area 506 of a cylinder head component 508. The cylinder head component 508 includes a sleeve portion 510 which is fixedly secured to a portion of a cylinder block 512. A main piston 514 is positioned within a cylinder 516 of the cylinder block 512. Dashed line 517 indicates one suitable location where a spark plug may be located, where the spark plug projects into a combustion chamber area 516*c*. The main piston 514 is attached to a connecting rod 518 for reciprocating motion within the cylinder 516 via a crankshaft 520. The crankshaft rotates within a crankcase 522. The cylinder 516 includes an air/fuel mixture intake port 516*a* and an exhaust port 516*b*, both in communication with the combustion chamber area 516*c*.

Within the interior area of the head assembly 502 is a biasing component 524, for example a coil spring, leaf spring, an electrically controllable dashpot, or any other suitable form of biasing implement. In this regard the biasing component 524 may have a fixed spring rate, or if it is an electrically controllable component like a dashpot, it may have an electrically adjustable spring rate set via an electrical signal from a processor or controller which sends electrical control signals to the biasing component. The biasing component 524 is positioned with one end against an upper surface 504*a* of the secondary piston 504 and the other end against an interior surface 502*a* of the cylinder head assembly. The biasing component 524 provides a predetermined biasing force (adjustable in real time if an electronically controllable dashpot is used), which acts to modify the volume of the combustion chamber 516*c* within the cylinder 516, and thus the compression ratio when the piston is at TDC of its stroke.

Referring to FIG. 7, a system 600 is shown in accordance with another embodiment of the present disclosure. In this embodiment the system 600 includes a cylinder head assembly 602 having a slidable inner liner 604 disposed within a cylinder head component 606. The slidable inner liner includes a wall portion 608 which is dimensioned to fit within, and to slide within, a cylinder wall 610 of a cylinder block 612. An outer wall portion 602*a* of the cylinder head assembly 602 may be fixedly secured to a distal wall section 606*a* of the cylinder head component 606.

A piston 614 is positioned for reciprocating motion within the slidable inner liner 604. The piston 614 is coupled to a connecting rod 616 which is in turn connected to a crankshaft 618 that rotates within a crankcase 620. Rotational movement of the crankshaft 618 drives the piston 614 in a reciprocating manner. A combustion chamber volume 622 is formed above a head portion 614*a* of the piston 604 and the inner surface 604*a* of the slidable inner liner 604. An air/fuel intake port 610*a* and an exhaust port 610*b* may be formed at appropriate locations on the cylinder wall 610.

Positioned within an inner area 602*a* of the cylinder head assembly 602 is a biasing component 624. The biasing component 624 may be a coil spring, a leaf spring, an electronically controllable element such as an electronically controllable dashpot, or any other biasing implement. The biasing component 624 is positioned between an inner wall surface 606*b* of the cylinder head component 606 and an upper wall portion 604*b* of the slidable inner liner 604. The biasing component 624 is thus able to exert a counteracting force on the air/fuel mixture within the combustion chamber 622 as the piston 614 moves toward TDC during its compression stroke, and thus to control the compression ratio when the piston is at TDC. Again, if the biasing component 624 is an electrically controllable component, the then the compression ratio may be adjusted in real time through suitable control signals from a controller associated with the vehicle's engine. Dashed line 625 indicates one suitable location for a spark plug. With the system 600 of FIG. 7, it will be appreciated that movement of the slidable inner liner 604 may necessitate a flexible cable for the spark plug, as well as a pathway (not shown) for egress of the spark plug cable or a connection to the contactor, out from the heat assembly 602 to an ignition system. Optionally, a suitable sliding contactor may be used in place of a flexible spark plug cable.

It will be appreciated then that a key feature of the various embodiments disclosed herein is that a form of elastic subassembly is included which allows the non-elastic compression ratio to be varied in a highly controlled manner.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A system for controlling ignition of an air/fuel mixture intake charge directed into an internal combustion engine, the system comprising:

a piston having a multi-piece skirt assembly having a first portion and a second portion coupled together to provide telescoping movement between the first and second portions;

the second portion further forming a movable component dimensioned to move slidably within a cylinder wall of the internal combustion engine and the coupling of the first and second portions forming a cavity;

the movable component being tuned to move in response to a predetermined pressure being reached in a combustion chamber of the cylinder during movement of the piston within the cylinder of the engine, as the piston travels toward top dead center during its compression stroke, to change a compression ratio of the engine; and a dashpot housed in the cavity, and operably associated with the piston, for providing a biasing force which is applied to the movable component.

2. The system of claim 1, wherein the first portion of the multi-piece skirt of the piston is adapted to be coupled to a connecting rod of the engine, and wherein the movable component includes a crown.

3. The system of claim 2, wherein the dashpot is interposed between the first and second skirt portions to provide a biasing force against which the movable component acts, the biasing force being overcome when the predetermined pressure is reached in the combustion chamber, thus enabling the second skirt portion to move toward the first skirt portion during a compression stroke of the piston.

4. The system of claim 3, further comprising a spring operably associated with the piston for providing an additional biasing force which acts on the movable component.

5. The system of claim 1, further comprising a Belleville washer operably associated with the piston for providing an additional biasing force which acts on the movable component.

6. The system of claim 1, wherein the dashpot is electrically responsive to an electrical signal from a remotely located component.

7. A system for controlling ignition of an intake charge directed into an internal combustion engine having a piston moving axially within a cylinder, a portion of the cylinder and a portion of a cylinder head forming a combustion chamber, and the piston moving towards and away from the cylinder head, the system comprising:

a movable component movable within at least one of the cylinder and within a portion of the cylinder head, independently of the piston;

a biasing component disposed in contact with the movable component to exert a biasing force on the movable component;

the biasing force helping to control axial movement of the movable component in response to a predetermined pressure being reached in the combustion chamber during a compression stroke of the piston, to change a compression ratio of the engine;

wherein the biasing component comprises a dashpot; and wherein the dashpot receives control signals from a remote component.

8. The system of claim 7, wherein the movable component forms a portion of the cylinder head and is disposed in at least one of the cylinder head or a wall of the cylinder.

9. The system of claim 7, wherein the movable component forms a portion of the cylinder.

10. A method for controlling ignition of an air/fuel mixture of an internal combustion engine, comprising:

configuring at least one of a combustion chamber or a cylinder of an engine with a movable component which is movable in response to a predetermined pressure being reached in the cylinder in which a piston is housed and moving axially in a reciprocating manner;

causing the movable component to move in response to the predetermined pressure being reached in the cylinder as the piston travels toward top dead center during a compression stroke, to influence a compression developed within the combustion chamber, and thus a temperature of the air/fuel mixture, to control ignition of the air/fuel mixture;

further controlling movement of the movable component in part by using a dashpot; and further using the dashpot to receive control signals from a remote component.

11. The method of claim 10, further comprising using the movable component to control a timing of combustion of the air/fuel mixture during the compression stroke.

12. A system for controlling ignition of an air/fuel mixture intake charge directed into a combustion chamber of an internal combustion engine, the system comprising:

a piston;

a movable component operably associated with the piston of the engine;

the movable component being tuned to move in response to a predetermined pressure being reached in the combustion chamber during movement of the piston within a cylinder of the engine, as the piston travels toward top dead center during its compression stroke, to change a compression ratio of the engine; and a dashpot operably associated with the piston for providing a biasing force which is applied to the movable component; and wherein the dashpot is electrically responsive to an electrical signal from a remotely located component.

13. A system for controlling ignition of an air/fuel mixture intake charge directed into a combustion chamber of an internal combustion engine, the system comprising:

a piston;

a movable component operably associated with the piston of the engine;

the movable component being tuned to move in response to a predetermined pressure being reached in the combustion chamber during movement of the piston within a cylinder of the engine, as the piston travels toward top dead center during its compression stroke, to change a compression ratio of the engine; and a dashpot operably associated with the piston for providing a biasing force which is applied to the movable component; and a cylinder head assembly, and wherein the movable component comprises a secondary piston, the secondary piston being at least partially housed within the cylinder head assembly.

* * * * *